US007721692B2

(12) United States Patent
Fischer

(10) Patent No.: US 7,721,692 B2
(45) Date of Patent: May 25, 2010

(54) CAM PHASER HAVING PRE-LOADED SPRING FOR BIASING THE ROTOR THROUGH ONLY A PORTION OF ITS RANGE OF AUTHORITY

(75) Inventor: Thomas H. Fischer, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 265 days.

(21) Appl. No.: 11/899,458

(22) Filed: Sep. 6, 2007

(65) Prior Publication Data

US 2009/0069097 A1 Mar. 12, 2009

(51) Int. Cl.
*F01L 1/34* (2006.01)

(52) U.S. Cl. ..... 123/90.17; 123/90.15; 123/90.31

(58) Field of Classification Search ..... 123/90.15, 123/90.16, 90.17, 90.18, 90.31, 90.37, 90.65
See application file for complete search history.

(56) References Cited

U.S. PATENT DOCUMENTS

| | | | | |
|---|---|---|---|---|
| 5,056,477 | A | 10/1991 | Linder et al. | |
| 5,172,662 | A | 12/1992 | Hampton | |
| 6,276,321 | B1 * | 8/2001 | Lichti et al. | 123/90.17 |
| 6,336,433 | B1 | 1/2002 | Anton et al. | |
| 6,405,695 | B2 | 6/2002 | Mizutani et al. | |
| 6,439,184 | B1 | 8/2002 | Takenaka et al. | |
| 6,450,138 | B1 | 9/2002 | Kinugawa et al. | |
| 6,505,586 | B1 | 1/2003 | Sato et al. | |
| 6,732,690 | B2 | 5/2004 | Pierik et al. | |
| 7,146,946 | B2 | 12/2006 | Yudate et al. | |
| 7,225,774 | B2 | 6/2007 | Watanabe et al | |
| 7,318,400 | B2 * | 1/2008 | Lipke et al. | 123/90.17 |
| 7,363,897 | B2 * | 4/2008 | Fischer et al. | 123/90.17 |
| 7,421,989 | B2 | 9/2008 | Fischer et al. | |
| 2002/0100445 | A1 | 8/2002 | Takenaka et al. | |
| 2007/0277757 | A1 * | 12/2007 | Fischer et al. | 123/90.17 |

OTHER PUBLICATIONS

Chang, C., Non-Final Office Action, mailed Nov. 15, 2007 in relation to U.S. Appl. No. 11/447,437, filed Jun. 6, 2006, Alexandria, VA.
Chang, C., Final Office Action, mailed May 14, 2008 in relation to U.S. Appl. No. 11/447,437, filed Jun. 6, 2006, Alexandria, VA.

(Continued)

*Primary Examiner*—Zelalem Eshete
(74) *Attorney, Agent, or Firm*—Thomas N. Twomey

(57) ABSTRACT

During assembly of an improved phaser, a rotor bias spring is captured by a spring retainer that is fitted or formed into the cover, allowing the spring to be installed in a pre-load position and forming a sub-assembly that is then attached to the remaining components. Grounded and active spring tangs are captured in separate slots in the spring retainer. A pocket within the rotor receives the active tang of the bias spring. The pocket has a tapered bottom ramp that lifts the active tang from the slot wall in the retainer and positions the active tang within the pocket in a retarding direction. Lifting the active tang of the bias spring prevents friction between the spring and the retainer slot wall as would occur as the rotor moves in a retarded direction. In advancing, spring rotation stops when the active tang contacts the end of the retainer slot.

15 Claims, 3 Drawing Sheets

OTHER PUBLICATIONS

Chang, C., Advisory Action, mailed Jul. 31, 2008 in relation to U.S. Appl. No. 11/447,437, filed Jun. 6, 2006, Alexandria, VA.
Chang, C., Non-Final Office Action, mailed Oct. 22, 2008 in relation to U.S. Appl. No. 11/447,437, filed Jun. 6, 2006, Alexandria, VA.
Chang, C., Final Office Action, mailed Mar. 24, 2009 in relation to U.S. Appl. No. 11/447,437, filed Jun. 6, 2006, Alexandria, VA.
Chang, C., Advisory Action, mailed Jun. 3, 2009 in relation to U.S. Appl. No. 11/447,437, filed Jun. 6, 2006, Alexandria, VA.

* cited by examiner

CAM PHASER HAVING PRE-LOADED SPRING FOR BIASING THE ROTOR THROUGH ONLY A PORTION OF ITS RANGE OF AUTHORITY

TECHNICAL FIELD

The present invention relates to phasers for varying the phase of valving with respect to a crankshaft in an internal combustion engine; more particularly, to such a phaser employing a spring for biasing the rotational position of a phaser rotor with respect to an associated phaser stator through at least a portion of the rotor range of authority; and most particularly, to such a phaser wherein a pre-loaded bias spring is active through only a portion of the range of authority of rotor rotation.

BACKGROUND OF THE INVENTION

Camshaft phasers for varying the timing of combustion valves in an internal combustion engine transmit crankshaft torque to the engine camshaft, allowing varied timing of the camshaft relative to the crankshaft position. Traditionally, intake phasers have authority to only advance this timing from their locked position. When insufficient oil pressure is available for controlled phasing, cam torque and the available oil pressure are used to drive the rotor to the fully retarded position where a lock pin in the rotor aligns with a seat in the stator. As engine speed decreases, oil pressure drops below the retraction pressure for the lock pin and the pin's bias spring urges the pin to move into engagement with its seat, preventing undesired phase angle changes until sufficient oil pressure is again available.

Phasers requiring an intermediate lock pin position between full rotor advance and full rotor retard cannot rely on the contract between the rotor and stator to realign the lock pin to its seat. Therefore, when oil pressure is low, some form of assistance is needed to advance the rotor away from full retard to align the lock pin to the seat at the intermediate rotor position. If the assistance were torque from a simple spring-arm system, the bias spring would cause the phaser to advance the rotor through the entire range of rotor authority and past the point where the lock pin aligns with its seat when resistive torque through the phaser system from the camshaft was less than the applied spring torque.

What is needed in the art is an improved bias system for a modern phaser having a rotor lock position intermediate in the rotor range of authority wherein the rotor is biased toward the lock position from all retard positions but is not biased toward the lock position from any advance position.

It is a principal object of the present invention to provide an improved phaser bias system.

SUMMARY OF THE INVENTION

Briefly described, the invention uses an applied torque between a phaser cover plate, mounted to the stator/sprocket, and phaser rotor to assist in aligning a lock pin to a seat in the stator at an intermediate position in the rotor range of authority. During assembly of the phaser, the bias spring is captured and guided by a spring retainer that is fitted or formed into the cover. The spring retainer allows the bias spring to be installed into the cover in its pre-load position and to be conveniently retained therein as both the grounded and active legs are captured in separate slot features in the spring retainer. This sub-assembly (cover, retainer, bias spring) is then readily attached to the remaining phaser components to complete the full assembly.

A pocket within the rotor receives the active leg of the bias spring extending from the spring retainer. The rotor pocket preferably has a tapered bottom face (ramp) that lifts the active leg of the bias spring off the axial slot wall in the spring retainer and locates the active leg against the wall of the rotor pocket when the rotor moves from the locked position in a retarding direction. Lifting the active tang of the bias spring removes any friction between the bias spring and the retainer slot wall that would occur as the rotor moves in a retarded direction from its intermediate locked position.

As the rotor moves in an advancing direction and the phase angle approaches the angle where locking would occur, the bias spring's rotation stops when the active tang contacts the end of the spring retainer slot. Contact between the active tang of the bias spring and the end of the slot in the spring retainer removes spring torque that otherwise would bias further advancement of the rotor. This permits the rotor to self-align to its locking position when oil pressure is removed during engine shut down or stall.

Further rotor motion in an advancing direction causes the tapered face in the bottom of the pocket in the rotor to lose contact with the bias spring tang, removing any axial contact between the bias spring active leg and the bottom face of the pocket in the rotor, and therefore prevents friction that otherwise would occur between the bias spring active tang and the rotor during rotor advance.

Without the spring retainer slot wall capturing the active tang of the bias spring, the spring would tip from axial alignment within the phaser and would continue to make contact with the bottom of the pocket in the rotor, creating frictional drag on the rotor as the rotor advances from the locking position.

The features of the invention therefore serve two purposes: easing phaser assembly, thus reducing cost and improving safety; and eliminating unwanted friction between the bias spring and rotor, thus improving performance and durability.

BRIEF DESCRIPTION OF THE DRAWINGS

The present invention will now be described, by way of example, with reference to the accompanying drawings, in which.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

Figure 1:
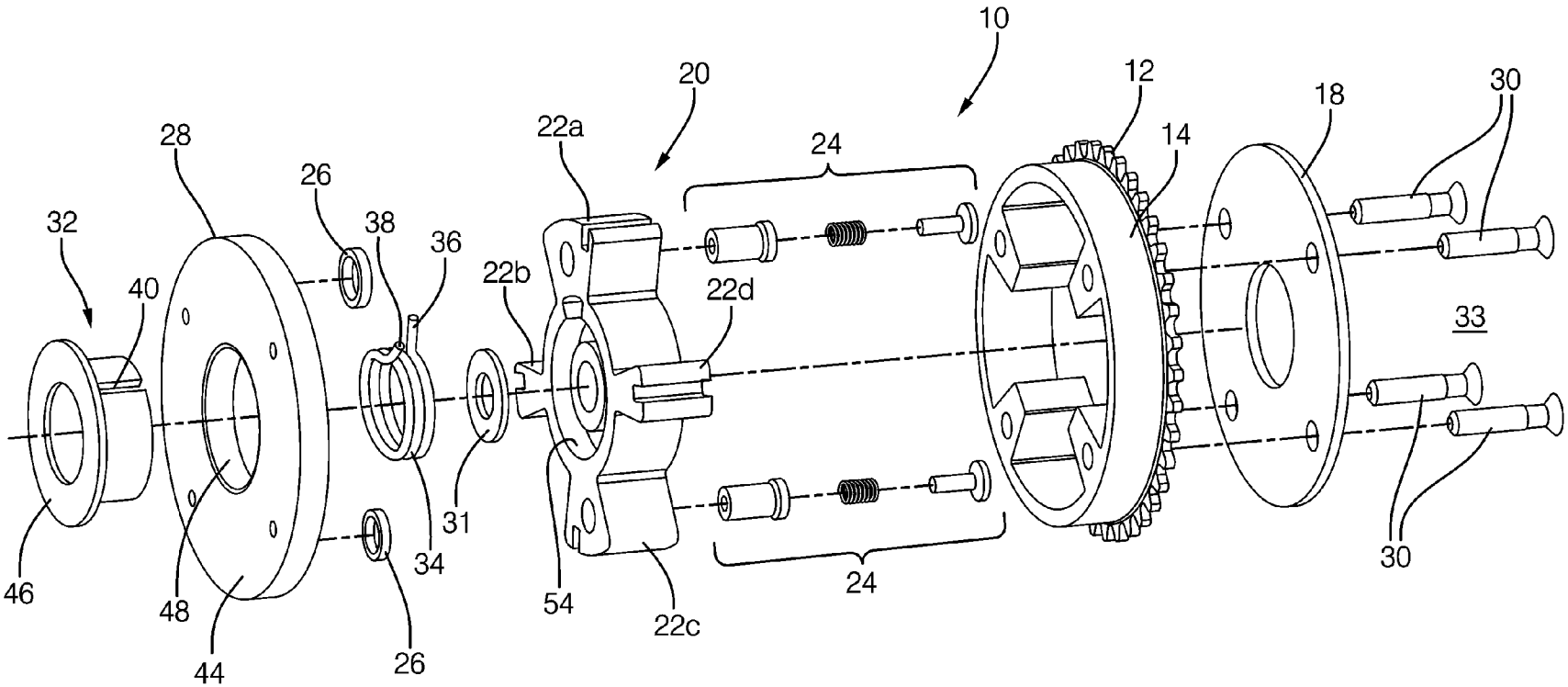
FIG. 1 is an exploded isometric view of a vane-type camshaft phaser in accordance with the invention.

Referring to FIGS. 1 through 8, a vane-type camshaft phaser 10 in accordance with the invention comprises a driving element 12 in the form of a sprocket wheel integral with a stator 14 having a plurality of inward-extending lobes 16. Of course, driving element 12 may take the form, as is known in the art, of a notched wheel for receiving a toothed timing belt or a gear for meshing with a timing gear. A bottom plate 18 forms a first wall of chambers formed within stator 14 between lobes 16. A rotor 20 having four vanes 22*a-d* is disposed for rotation within stator 14 in known fashion. Rotor 20 has at least one, and preferably two, lock pins assemblies 24 hydraulically extendable to engage seats 26 in a cover plate 28 for rotationally locking the rotor to the stator as may be desired. Cover plate 28 defines a second wall of the chambers in stator 14. Binder screws 30 extend through bottom plate 18 and stator 14, and are threadedly received in cover plate 28. A thrust washer 31 is disposed against the hub of rotor 20 for receiving a camshaft-mounting bolt (not shown) during assembly of engine 33. A spring retainer 32 receives a helical bias spring 34 having first and second radially-extending tangs 36,38. First tang 36 is grounded in a first axial slot 40 formed in the wall of spring retainer 32 and is defined herein as the "inactive" tang. Second tang 38 is grounded in a second slot 42 formed in the wall of spring retainer 32 and is defined herein as the "active" tang. Second slot 42 preferably includes an axial entry portion and a circumferential portion permitting rotation of second tang 38 during operation of the phaser. Spring retainer 32 extends through an opening 44 in cover plate 28 and includes a collar 46 that grounds against the outer surface 48 of cover plate 28 during assembly. Preferably a notch 50 is provided in the rim of opening 44 for receiving first tang 36 extending beyond the wall of spring retainer 32. Alternatively, retainer 32 may be formed into the cover such as, for example, by casting.

Figure 2:
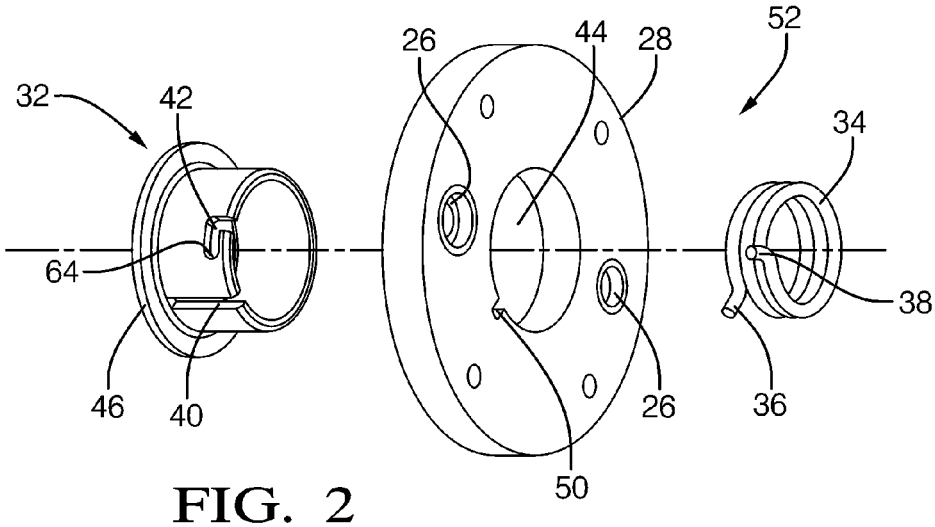
FIG. 2 is an exploded isometric view of a cover plate subassembly in accordance with the invention.
Figure 3:
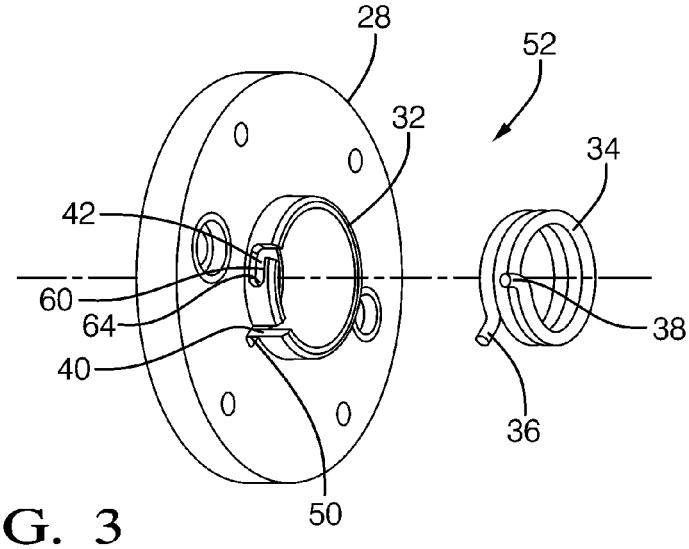
FIG. 3 is an exploded view derived from FIG. 2 showing the spring retainer fitted into the cover plate with the first slot and the cover plate notch aligned.
Figure 4:
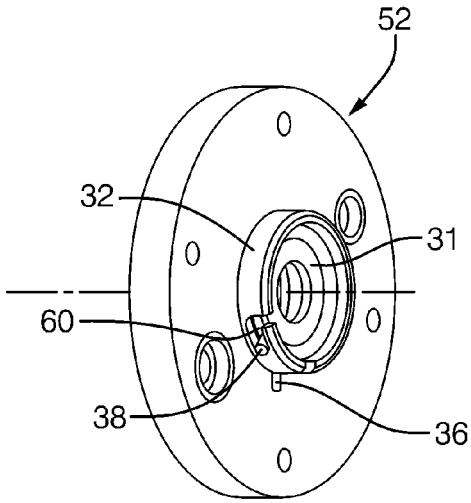
FIG. 4 is an isometric view of the cover plate subassembly.
Figure 6:
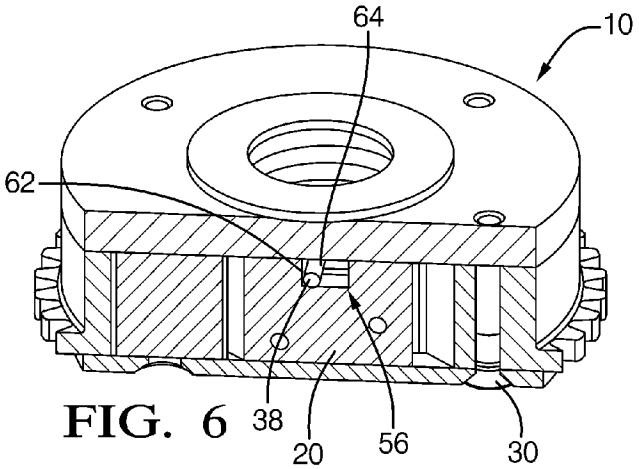
FIG. 6 is an isometric view of an assembled camshaft phaser including a cross-sectional view taken off-axis through a pocket in the rotor, showing the rotor in locked position.
Figure 8:
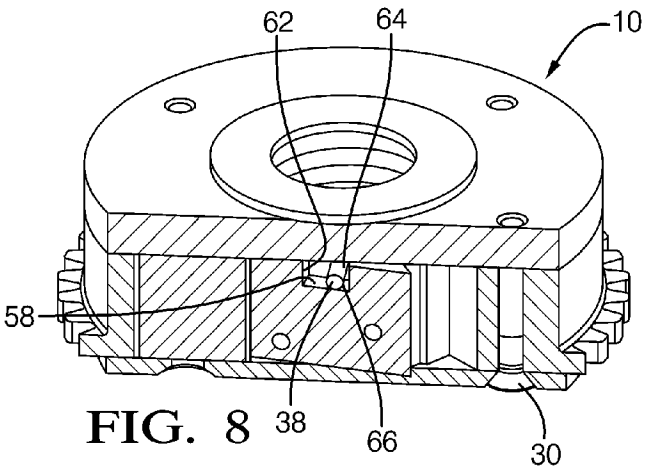
FIG. 8 is an isometric view of an assembled camshaft phaser including a cross-sectional view taken off-axis through a pocket in the rotor, showing the rotor in an advanced position.
Figure 5:
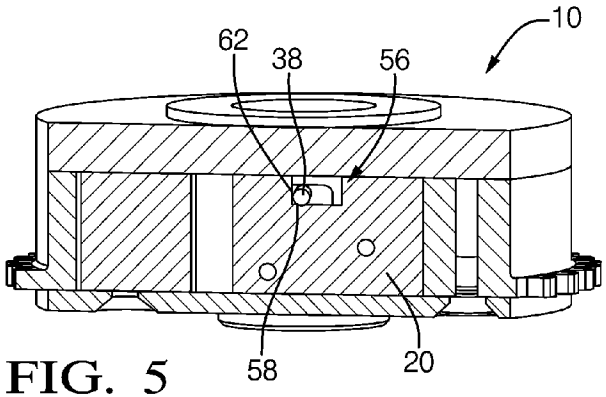
FIG. 5 is an isometric view of an assembled camshaft phaser including a cross-sectional view taken off-axis through a pocket in the rotor, showing the rotor fully retarded from locked position.
Figure 7:
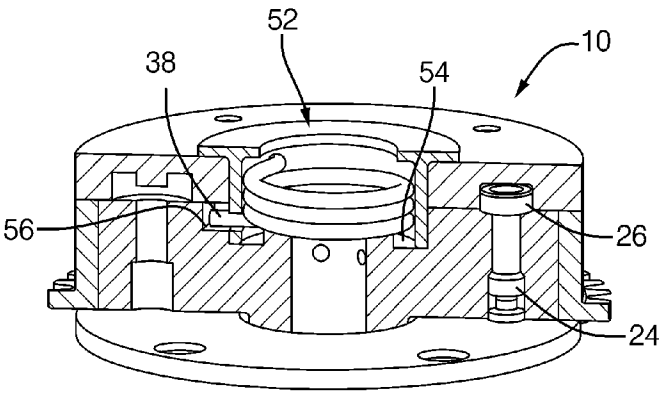
FIG. 7 is an isometric view of an assembled camshaft phaser including an axial cross-sectional view, also showing the rotor in locked position.

During assembly of phaser 10, bias spring 34 is captured and guided by spring retainer 32 that is press fit or formed into cover plate 28 with first slot 40 aligned with notch 50. Referring to FIGS. 2 through 4, in forming a cover plate subassembly 52, first tang 36 is inserted into slot 40 to a depth until second tang 38 engages the end of spring retainer 32. Bias spring 34 is then wound until second tang 38 aligns with second slot 42; the spring is then pushed further into spring retainer 32 and then released, thus the spring is captured at a pre-load position, creating subassembly 52. The spring retainer allows the bias spring to be installed into the cover in its pre-load position and to be conveniently retained therein as both the inactive and active tangs are captured in separate slot features in the spring retainer.

Subassembly 52 is then attached by binder screws 30 to the remaining phaser components to complete the full phaser assembly 10. An annular well 54 in rotor 20 receives the portion of subassembly 52 extending beyond cover plate 28. A pocket 56 within the rotor and outboard of well 54 receives active tang 38 and preferably has a tapered bottom face defining a ramp 58. Ramp 58 extends angularly across the lower wall 60 of second slot 42 and receives active tang 38 as spring 34 is torsionally actuated by rotation of rotor 20.

In operation, when the rotor moves in a retarding direction (FIG. 5), from an intermediate position in which the rotor may be locked, rotor ramp 58 lifts active tang 38 off the lower slot wall 60 (hidden in FIG. 5) and positions tang 38 against a first end wall 62 of rotor pocket 56. Lifting the active tang of the bias spring removes any friction between the spring tang and the slot wall that would otherwise occur as the rotor moves in a retarded direction toward a full retarded authority position from its intermediate position.

As rotor 20 moves in an advancing direction from a retard position and approaches the phase angle at which locking can occur (FIGS. 6 and 7), the torsional rotation of bias spring 34 stops when active tang 38 makes contact with end wall 64 (FIGS. 2 and 3) of spring retainer slot 42. Contact between the active leg of the bias spring and the end of the slot in the spring retainer arrests the spring from further uncoiling and thus prevents spring torque from biasing the advance of the rotor in the advance direction past the locking point. This permits the rotor to self-align to its locking position when oil pressure is removed during engine shut down or stall.

Further motion of rotor 20 past the locking position in an advancing direction toward a full advanced authority position (FIG. 8) causes ramp 58 to be disengaged from active tang 38, removing any axial contact between the bias spring active tang and the non-ramp bottom face 66 of pocket 56, and therefore prevents frictional drag that otherwise would occur between the bias spring active tang and the rotor during rotor advance.

Without slot wall 64 capturing active tang 38, the spring would tip from axial alignment within the phaser and would continue to make contact with bottom face 66 as the rotor advances from the intermediate position.

The present invention has been described above in terms of a novel camshaft phaser being applied to an intake valve camshaft and biasing the rotor in the advance direction from retard positions. However, those of ordinary skill in the phaser art will realize that the disclosed invention is not so limited and may be applied to exhaust valve camshafts as well as to biasing the rotor in the retard direction from advanced positions as may be desired.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A camshaft phaser for varying the phase of a combustion valve in an internal combustion engine, comprising:

a) a stator;

b) a rotor disposed within said stator and having an annular well and a pocket formed in an axial side thereof and having a range of rotational authority within said stator including a first full authority position, a second full authority position opposite the first full authority position, and an intermediate position between said first and second full authority positions;

c) a cover plate for enclosing said rotor within said stator;

d) a spring retainer fixed to said cover plate for rotation with said stator; and e) a bias spring having first and second tangs and being disposed within said spring retainer, wherein said spring retainer includes first and second axially-extending slots for receiving said first and second tangs, respectively, said second slot also having a circumferential portion having an end wall, and wherein said first tang is grounded in said first slot and said second tang is rotatable within said circumferential portion, and wherein said second tang engages an axial wall of said pocket to bias said rotor toward said intermediate position when said rotor is in a position between said intermediate position and one of said first or second full authority positions, and wherein said second tang engages said end wall of said circumferential portion to prevent bias of said rotor when said rotor is in a position between said intermediate position and the other of said first or second full authority positions.

2. A camshaft phaser in accordance with claim 1 wherein a notch in said cover plate and said first slot are radially aligned and wherein said first tang protrudes radially from said first slot to engage said notch.

3. A camshaft phaser in accordance with claim 1 wherein said bias spring is torsionally pre-loaded in said spring retainer.

4. A camshaft phaser in accordance with claim 1 further comprising a driving element integral with said stator, and bottom plate, and binder screws for joining said bottom plate, stator and cover plate.

5. A camshaft phaser in accordance with claim 1 wherein said rotor pocket includes a bottom wall, wherein a first portion of said bottom wall defines a ramp for engaging and displacing said second tang axially during at least a portion of said rotational authority of said rotor.

6. A camshaft phaser in accordance with claim 5 wherein said bottom wall includes a second and non-ramp portion that is free of contact with said second tang during at least another portion of said rotational authority of said rotor.

7. A camshaft phaser for varying the phase of a combustion valve in an internal combustion engine, comprising:

a) a stator;

b) a rotor disposed within said stator and having an annular well and a pocket formed in an axial side thereof and having a range of rotational authority within said stator including a first full authority position, a second full authority position opposite the first full authority position, and an intermediate position between said first and second full authority positions;

c) a cover plate for enclosing said rotor within said stator and having a central opening;

d) a spring retainer disposed within said central opening and extending into said annular well; and e) a bias spring having first and second tangs and being disposed within said spring retainer and also extending into said annular well, wherein said spring retainer includes first and second axially-extending slots formed in a wall thereof for receiving said first and second tangs, respectively, said second slot also having a circumferential portion having an end wall, and wherein said first tang is grounded in said first slot and said second tang is rotatable within said circumferential portion, and wherein said second tang protrudes into said rotor pocket, and wherein said second tang engages an axial wall of said pocket to bias said rotor toward said intermediate position when said rotor is in a position between said intermediate position and one of said first or second full authority positions, wherein said second tang engages said end wall of said circumferential portion to prevent bias of said rotor when said rotor is in a position between said intermediate position and the other of said first or second full authority positions, and wherein said rotor pocket includes a bottom wall, wherein a first portion of said bottom wall defines a ramp for engaging and displacing said second tang axially during at least a portion of said rotational authority of said rotor.

8. A camshaft phaser in accordance with claim 7 wherein said bottom wall includes a second and non-ramp portion that is free of contact with said second tang during at least another portion of said rotational authority of said rotor.

9. An internal combustion engine comprising a camshaft phaser disposed on a camshaft thereof, wherein said camshaft phaser includes a stator, a rotor disposed within said stator and having an annular well and a pocket formed in an axial side thereof and having a range of rotational authority within said stator including a first full authority position, a second full authority position opposite the first full authority position, and an intermediate position between said first and second full authority positions, a cover plate for enclosing said rotor within said stator, a spring retainer fixed to said cover plate for rotation with said stator, and a bias spring having first and second tangs and being disposed within said spring retainer, wherein said spring retainer includes first and second axially-extending slots for receiving said first and second tangs, respectively, said second slot also having a circumferential portion having an end wall, and wherein said first tang is grounded in said first slot and said second tang is rotatable within said circumferential portion, and wherein said second tang engages an axial wall of said pocket to bias said rotor toward said intermediate position when said rotor is in a position between said intermediate position and one of said first or second full authority positions, and wherein said second tang engages said end wall of said circumferential portion to prevent bias of said rotor when said rotor is in a position between said intermediate position and the other of said first or second full authority positions.

10. A camshaft phaser for varying the phase of a combustion valve in an internal combustion engine, comprising:

a) a stator;

b) a rotor disposed within said stator and having an annular well and a pocket formed in an axial side thereof and having a range of rotational authority within said stator including a first full authority position, a second full authority position opposite the first full authority position, and an intermediate position between said first and second full authority positions;

c) a spring retainer fixed for rotation with said stator; and e) a bias spring having first and second tangs, wherein said spring retainer includes first and second slots for receiving said first and second tangs, respectively, said second slot having a circumferential portion having an end wall, and wherein said second tang engages a wall of said pocket to bias said rotor toward said intermediate position when said rotor is in a position between said intermediate position and one of said first or second full authority positions, and wherein said second tang engages said end wall of said circumferential portion to prevent bias of said rotor when said rotor is in a position between said intermediate position and the other of said first or second full authority positions.

11. A camshaft phaser in accordance with claim 10 further comprising a cover plate for enclosing said rotor within said stator, wherein a notch in said cover plate and said first slot are radially aligned and wherein said first tang protrudes radially from said first slot to engage said notch.

12. A camshaft phaser in accordance with claim 10 wherein said bias spring is torsionally pre-loaded in said spring retainer.

13. A camshaft phaser in accordance with claim 11 further comprising a driving element integral with said stator, and bottom plate, and binder screws for joining said bottom plate, said stator and said cover plate.

14. A camshaft phaser in accordance with claim 10 wherein said rotor pocket includes a bottom wall, wherein a first portion of said bottom wall defines a ramp for engaging and displacing said second tang axially during at least a portion of said rotational authority of said rotor.

15. A camshaft phaser in accordance with claim 14 wherein said bottom wall includes a second and non-ramp portion that is free of contact with said second tang during at least another portion of said rotational authority of said rotor.

* * * * *